US005492577A

United States Patent [19]

Rauber et al.

[11] Patent Number: 5,492,577

[45] Date of Patent: Feb. 20, 1996

[54] PERCUSSION PRIMER COMPOUND AND METHOD FOR ITS PREPARATION

[75] Inventors: Walter Rauber, Gwatt; Markus Tobler, Seftigen, both of Switzerland

[73] Assignee: Schweizerische Eidgenossenschaft vertreten durch die SM Schweizerische Munitionsunternehmung der Gruppe fur Rustungsdienste, Thun, Switzerland

[21] Appl. No.: 335,120

[22] Filed: Nov. 7, 1994

[30] Foreign Application Priority Data

Nov. 9, 1993 [CH] Switzerland ..... 3360/93

[51] Int. Cl.$^6$ ..... C06B 33/10

[52] U.S. Cl. ..... 149/39

[58] Field of Search ..... 149/37, 39

[56] References Cited

U.S. PATENT DOCUMENTS 4,566,921 1/1986 Duguet ..... 149/22
4,756,250 7/1988 Dias dos Santos ..... 102/275.1

FOREIGN PATENT DOCUMENTS 370403 3/1983 Austria ..... C06B 49/00

*Primary Examiner*—Donald P. Walsh
*Assistant Examiner*—Anthony R. Chi
*Attorney, Agent, or Firm*—Schweitzer Cornman & Gross

[57] ABSTRACT

A percussion primer compound for small arms, comprising a special metal such as zirconium as a reducing agent and a mixture of two oxygen carriers with oxidizing potentials of different magnitudes as oxidizing agent. The primer compound may be used in cartridge-type, small-caliber small arms such as is used for training purposes.

9 Claims, No Drawings

PERCUSSION PRIMER COMPOUND AND METHOD FOR ITS PREPARATION

The present invention relates to a percussion primer compound for the initiation of a propellant charge in small arms, wherein the primer compound consists of at least one reducing and oxidizing agent and contains at least one binder. As used herein, the term "propellant charge" typically corresponds to the equally common designations "gun powder" or "gun propellant", but is also intended to encompass pyrotechnical charges.

Primer and ignition compounds for small arms are known from AT-PS-370 403. These compounds contain heavy-metal salts of aromatic nitro compounds. Such primer compounds generate injurious gases, particularly if used in closed rooms for training purposes.

Other initiating explosives known in the prior art, containing such heavy metals as antimony, barium, lead, mercury and the like, are no longer wanted today because of their emissions and residues in firing ranges. The same also holds true for zinc-containing pyrotechnical compounds. On the other hand, organic nitrogen compounds known to be used as initiators, such as diazo compounds, triazoles, tetrazoles or the like, are objectionable because of their carcinogenic properties, which applies both to the primer substance and to its decomposition products.

It is accordingly the object of the invention to provide a primer compound free of injurious substances and harmful emissions and a method for its preparation.

According to the invention, such an object is achieved in a primer compound having a reducing agent comprising a pulverulent, activated special metal, and an oxidizing agent comprising two oxygen carriers with oxidizing potentials of different magnitudes. These reactants are combined with at least one secondary explosive and one binder. It is to be recognized that a "secondary explosive" encompasses one explosive which, upon burn, delivers additional energy for ignition of the main propellent charge.

An essential advantage of the invention resides in the fact that both reducing and oxidizing agents consist exclusively of inorganic compounds. Their reaction products are thus noncarcinogenic.

DETAILED DESCRIPTION OF THE INVENTION

The present invention may be preferably embodied in a composition including zirconium as the special metal reducing agent. The oxidizing agents are preferably manganese dioxide and potassium nitrate. Manganese dioxide has a sufficiently high reaction potential. It is also very economical. Commercially-obtainable, activated manganese dioxide is highly reactive and facilitates good combustion of zirconium. In the process, it is itself reduced to metallic manganese.

Potassium nitrate has been found to give best results as an oxygen carrier with a low reaction potential. Its oxidizing potential is somewhat lower than that of the manganese dioxide; therefore it releases its oxygen only after a certain energy level from the reaction of the zirconium with the manganese dioxide has been reached.

Nitrated aliphatic polyalcohols have been found suitable as secondary explosives for the primer compound of the present invention, as upon burning they merely form carbon dioxide, nitrogen or nitrogen oxides. Pentaerythrol tetranitrate, also known as nitropenta or PETN, is a preferred secondary explosive.

The primer and secondary explosive may be combined with a binder preferably composed of isopropanol and aerosil. Such a binder forms a pasty dough, which is particularly suitable for zirconium as a reducing agent metal and the corresponding oxidizing agents. Although aerosil can produce ignition by friction, experiments have indicated that, in the primer compound according to the invention, ignition by impact occurs prior to the time any friction-induced ignition would occur.

A preferred zirconium powder (Specification CX) used according to the invention as the reducing agent has the following characteristics:

| | |
|---|---|
| Bulk density | 1.25 g/cm$^3$ |
| Ignition point | 180° C. ± 10° |
| Combustion time | 7 ± 3 s/50 cm |
| Particle size 100% | <40 μm |
| Particle size acc. to Blaine | 1.7 μm ± 0.2 μm |
| Spec. surface | 1.8 m$^2$/g |
| Oxidation value | 30.5% ± 0.5% (Weight increase during combustion) |

Other special metals may be chosen if corresponding adapted oxygen carriers are chosen.

Compositions in the following ranges have proved suitable for the primer compound of the present invention. The components of such compositions are per se known and commercially available.

Manganese IV oxide from 40.0 to 50.0 wt. %, zirconium in the form of the activated powder from 17.0 to 23.0 wt. %, pentaerythrol tetranitrate (nitropenta) from 13.0 to 17.0 wt. %, potassium nitrate from 17.0 to 23.0 wt. % and aerosil from 0.4 to 0.6 wt. %.

Best results were shown by a compound of the following mixture proportions:

Manganese dioxide 44.5 wt. %, zirconium 20.0 wt. %, pentaerythrol tetranitrate (nitropenta) 15.0 wt. %, potassium nitrate 20. 0 wt. % and aerosil 0. 5 wt %.

The course of the ignition process when using the primer compound according to the invention can be described as follows:

Activated forms of zirconium (zirconium with its surface area increased by surface treatment; e.g., by hydrogen doping) ignite under slight energy application, either mechanical (impact, friction) or thermal (e.g., Joule effect).

The required ignition temperature lies between 180° C. and 280° C. Oxygen required for the reaction is primarily and rapidly taken from the manganese dioxide. A further oxygen carrier is available in the form of the potassium nitrate, which supports pressure build-up in such a way that, energy-wise, the necessary preconditions for initiation of the secondary explosive are fulfilled. The latter burns and acts as a further energy contributor in the ignition chain.

Surprisingly, even in the absence of commonly used initial explosives, the primer compound of the present invention permits sufficient peak pressures to be reached without loss of brisance. While a primer compound of the conventional type (on the basis of lead styphnate) may generate a $P_{max}$ of 100 to 120 bar, a primer compound according to the present invention (free of an initiating explosive) generates a $P_{max}$ of 70 to 75 bar. This is sufficient for reliable performance as part of the ignition chain.

Ballistic firing tests have furthermore shown that, in a 9 mm caliber pistol, a primer compound according to the invention meets all demands made on the weapon and its ammunition. As the dwell time of the projectile in the barrel increases, the pressure developed by the powder combustion gases can be better utilized. Reproducible muzzle velocities of about 366 m/s have been measured; these are substantially identical with velocities achieved with conventional, lead-containing primer compounds.

A preferred method for production of the primer compound of the present invention comprises the rinsing of the activated and temporarily stabilized zirconium metal powder with an organic solvent. The powder is subsequently mixed with the other components, kneaded, dried and pressed to form a primer element.

Particular attention should be paid during the preparation of the pulverulent, activated zirconium for it to be always in the wetted state. The zirconium is preferably obtainable from Degussa AG, of Hanau, Germany, with a water content of about 30% in an activated form achieved by increase of surface porosity. If it is intended to work on an organic basis, the water content of the zirconium powder must ultimately be displaced by an appropriate solvent, such as an aliphatic alcohol such as isopropanol. Repeated washing of the water-stabilized zirconium with isopropanol has been found to give good results, the isopropanol physically displacing the water and serving as a binder for the primer mass.

The potassium nitrate is preferably prepared by dry-grinding in a ball mill and, by screening, a particle size of a maximum of 250 μm is obtained. During this step, air humidity should be between 40 to 70%. Too dry an atmosphere (humidity of less than 40%) leads to strong dust generation, while too humid an atmosphere (humidity of more than 70%) leads to undesirable lump formation in the ground potassium nitrate. After drying, the ground potassium nitrate must be kept in tightly closed containers until its use.

Pantaerythrol tetranitrate may be chosen as a secondary explosive because of its high initiation avidity. It is prepared for incorporation into the primer compound by grinding in water in a ball mill to a particle size of a maximum of 500 μm. The ground mass is transferred in the wet state onto a screening material, where it is flushed with water and the fraction from 125 to 250 μm is collected. Prior to further processing, the fraction is dried in a desiccator (at 45° to 50° C., 150 mbar).

Other secondary explosives can be used, instead of pentaerythrol tetranitrate, as can suitable propellant charges, formed e.g., from nitrated alcohols and nitrated ether, such as nitroglycerin and nitroglycol.

The other components of the above-described primer compound can be directly used in their commercially obtainable form. The relevant literature indicates that all components of the primer element as provided for herein may be regarded as toxologically unobjectionable.

All the components are combined and subsequently mixed in a mixing vessel by means of a kneading or stirring machine, until a smooth, pasty consistency is obtained. Subsequently, the primer compound mass is dried only until pasty and is then applied in a per se known manner to a prepared substrate, onto which it is pressed, so that a primer element such as a primer cap is produced.

We claim:

1. A percussion primer compound for initiating a propellant charge in small arms, comprising the combination of a pulverulent, activated special metal reducing agent, an oxidizing agent comprising two oxygen carriers, each having a different oxidizing potential, at least one secondary explosive and at least one binder, said reducing agent, oxidizing agents, secondary explosive and at least one binder being combined in the absence of heavy metal compounds.

2. The percussion primer as claimed in claim 1, wherein the special metal is zirconium.

3. The percussion primer as claimed in claim 1, wherein the oxygen carrier with a higher oxidizing potential is manganese dioxide.

4. The percussion primer as claimed in claim 1, wherein the oxygen carrier with a lower oxidizing potential is potassium nitrate.

5. The percussion primer as claimed in claim 1, wherein the at least one secondary explosive comprises a nitrated aliphatic polyalcohol.

6. The percussion primer as claimed in claim 5, wherein the at least one secondary explosive comprises pentaerythrol tetranitrate.

7. The percussion primer as claimed in claim 1, wherein the at least one binder comprises isopropanol and aerosil.

8. The percussion primer of claim 1, wherein said primer comprises: manganese dioxide as a first oxygen carrier at 40 to 50 wt. %;

zirconium as the special metal at 17 to 23 wt. %;

pentaerythrol tetranitrate as a secondary explosive at 13 to 17 wt. %;

potassium nitrate as a second oxygen carrier at 17 to 23 wt. %; and aerosil as a binder at 0.4 to 0.6 wt. %.

9. A method for the preparation of a percussion primer compound, comprising the steps of rinsing activated and temporarily stabilized zirconium powder with an organic solvent; and combining the zirconium powder with said oxygen carriers, at least one binder and at least one secondary explosive, and subsequently kneading, drying and pressing the resultant mass without the inclusion of any heavy metal compound to form a primer element.

* * * * *